US009657574B2

(12) United States Patent
Nishimoto et al.

(10) Patent No.: US 9,657,574 B2
(45) Date of Patent: May 23, 2017

(54) ROTOR OF ROTARY MACHINE AND ROTARY MACHINE

(71) Applicant: MITSUBISHI HEAVY INDUSTRIES, LTD., Tokyo (JP)

(72) Inventors: Shin Nishimoto, Tokyo (JP); Yoshinori Tanaka, Tokyo (JP); Takashi Nakano, Tokyo (JP); Kenji Kawasaki, Tokyo (JP); Ryuichi Yamamoto, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 183 days.

(21) Appl. No.: 14/592,057

(22) Filed: Jan. 8, 2015

(65) Prior Publication Data

US 2015/0125280 A1 May 7, 2015

Related U.S. Application Data

(63) Continuation of application No. 13/357,876, filed on Jan. 25, 2012, now abandoned.

(30) Foreign Application Priority Data

Mar. 30, 2011 (JP) ..... 2011-074206

(51) Int. Cl.
*F01D 1/04* (2006.01)
*F01D 5/06* (2006.01)
(Continued)

(52) U.S. Cl.
CPC ..... *F01D 5/06* (2013.01); *C22C 19/055* (2013.01); *C22C 19/056* (2013.01);
(Continued)

(58) Field of Classification Search
CPC ... F01D 1/04; F01D 5/06; F01D 5/063; F01D 5/066; F01D 25/24; F05D 2230/31;
(Continued)

(56) References Cited

U.S. PATENT DOCUMENTS 5,411,365 A 5/1995 Mazzola et al.
5,414,929 A 5/1995 Floser et al.
(Continued)

FOREIGN PATENT DOCUMENTS

CN 1209186 2/1999
CN 1294250 5/2001
(Continued)

OTHER PUBLICATIONS

Machine translation of DE 496430 C (Apr. 22, 1930) from Espacenet.*
(Continued)

*Primary Examiner* — Gregory Anderson
*Assistant Examiner* — Christopher R Legendre
(74) *Attorney, Agent, or Firm* — Wenderoth, Lind & Ponack, L.L.P.

(57) ABSTRACT

A rotor (10) of a rotary machine (T1) according to the invention includes a plurality of rotor members (20, 30, and 40) which are joined to each other in the axial direction in which the axis (P) extends, and among the plurality of rotor members (20, 30 and 40), the first rotor member (30) in hydraulic fluid injection portions (3*a* and 3*b*) of a passageway (3) is formed of Ni-based alloy so that the inside thereof is hollow throughout the entire length in the axial direction.

16 Claims, 5 Drawing Sheets

(51) Int. Cl.
*F01D 25/10* (2006.01)
*F01D 25/24* (2006.01)
*C22C 19/05* (2006.01)

(52) U.S. Cl.
CPC ..... *C22C 19/057* (2013.01); *F01D 1/04* (2013.01); *F01D 5/063* (2013.01); *F01D 25/10* (2013.01); *F01D 25/24* (2013.01); *F05D 2220/31* (2013.01); *F05D 2260/941* (2013.01); *F05D 2300/171* (2013.01); *F05D 2300/177* (2013.01)

(58) Field of Classification Search
CPC ..... F05D 2260/941; F05D 2300/171; F05D 2300/177
See application file for complete search history.

(56) References Cited

U.S. PATENT DOCUMENTS

| | | | | | |
|---|---|---|---|---|---|
| 6,129,514 | A * | 10/2000 | Shiga | C22C 38/44 | 415/199.5 |
| 6,152,697 | A * | 11/2000 | Konishi | F01D 5/063 | 416/198 A |
| 6,237,338 | B1 * | 5/2001 | Magoshi | F01D 9/06 | 415/134 |
| 6,499,946 | B1 * | 12/2002 | Yamada | C22C 38/22 | 415/199.4 |
| 7,946,813 | B2 * | 5/2011 | Fukuda | C22C 19/055 | 29/889.2 |
| 8,128,341 | B2 * | 3/2012 | Wieghardt | F01D 3/04 | 415/106 |
| 8,347,499 | B2 * | 1/2013 | Grzondziel | B22D 25/02 | 164/460 |
| 8,513,841 | B2 * | 8/2013 | Rotzinger | B23K 33/006 | 219/121.14 |
| 8,523,519 | B2 | 9/2013 | Breitenbach et al. | | |
| 8,883,072 | B2 * | 11/2014 | Sato | B23K 35/004 | 148/336 |
| 8,911,880 | B2 * | 12/2014 | Nishimoto | B23K 31/02 | 148/579 |
| 8,944,761 | B2 * | 2/2015 | Farineau | F01D 5/026 | 415/216.1 |
| 9,109,449 | B2 * | 8/2015 | Shige | B23K 35/30 | |
| 2004/0007830 | A1 | 1/2004 | Uematsu et al. | | |
| 2007/0189894 | A1 * | 8/2007 | Thamboo | B23K 15/0006 | 415/216.1 |
| 2009/0060735 | A1 | 3/2009 | Ganesh et al. | | |
| 2009/0074584 | A1 | 3/2009 | Nemoto et al. | | |
| 2010/0092301 | A1 | 4/2010 | Scarlin | | |
| 2010/0202891 | A1 * | 8/2010 | Nishimoto | F01D 5/06 | 416/241 R |
| 2010/0239425 | A1 | 9/2010 | Miyashita et al. | | |
| 2010/0296938 | A1 | 11/2010 | Nishimoto et al. | | |
| 2010/0310411 | A1 | 12/2010 | Ohsaki et al. | | |
| 2011/0206525 | A1 | 8/2011 | Shige et al. | | |
| 2011/0229339 | A1 * | 9/2011 | Yamada | F01D 5/06 | 416/244 R |
| 2012/0251307 | A1 | 10/2012 | Nishimoto et al. | | |
| 2015/0125280 | A1 * | 5/2015 | Nishimoto | F01D 5/063 | 415/199.4 |

FOREIGN PATENT DOCUMENTS

| | | | | |
|---|---|---|---|---|
| CN | 101300405 | 11/2008 | | |
| CN | 101480705 | 7/2009 | | |
| CN | 101765702 | 6/2010 | | |
| CN | 101790595 | 7/2010 | | |
| CN | 101946015 | 1/2011 | | |
| EP | 1 800 787 | 6/2007 | | |
| EP | 2 172 299 | 4/2010 | | |
| EP | 2 180 147 | 4/2010 | | |
| FR | 2192598 | 2/1974 | | |
| JP | 33-9552 | 10/1958 | | |
| JP | 5-240001 | 9/1993 | | |
| JP | 7-77004 | 3/1995 | | |
| JP | 8-121102 | 5/1996 | | |
| JP | 9-53404 | 2/1997 | | |
| JP | 2837110 | 12/1998 | | |
| JP | 11-093607 | 4/1999 | | |
| JP | 2000-64805 | 2/2000 | | |
| JP | 2000-282808 | 10/2000 | | |
| JP | 2000-356110 | 12/2000 | | |
| JP | 2002-121654 | 4/2002 | | |
| JP | 2003-13161 | 1/2003 | | |
| JP | 2005-121023 | 5/2005 | | |
| JP | 2007-321630 | 12/2007 | | |
| JP | 2007321630 A * | 12/2007 | F04D 5/06 | |
| JP | 2008-88525 | 4/2008 | | |
| JP | 2009-57975 | 3/2009 | | |
| JP | 2009-191301 | 8/2009 | | |
| JP | 2010090805 A * | 4/2010 | F01D 5/063 | |
| RU | 2 322 589 | 4/2008 | | |
| WO | 2009/154243 | 12/2009 | | |
| WO | 2010/053023 | 5/2010 | | |

OTHER PUBLICATIONS

M. Sato et al., "The Thermal and Nuclear Power" Journal, The Thermal and Nuclear Power Engineering Society, vol. 57, No. 601, Oct. 15, 2006, pp. 89-106 (with partial English translation).
Japanese Notice of Reasons for Rejection issued Feb. 24, 2015 in corresponding Japanese Patent Application No. 2014-219739 with English translation.
U.S. Patent Office Action issued Oct. 10, 2014 in corresponding U.S. Appl. No. 13/357,876.
Office Action issued Jun. 17, 2016 in corresponding Chinese Application No. 201510105595.1, with English translation.
Notice of Cancellation Reason issued May 27, 2016 in corresponding Japanese Application No. 2014-219739.
Chinese Office Action issued Nov. 27, 2015 in corresponding Chinese Application No. 201510105595.1 (English Translation).
Extended European Search Report issued Jul. 10, 2015 in corresponding European Patent Application No. 151613551.1.
Notice of Cancellation Reason issued Sep. 20, 2016 in corresponding JP Application No. 2015-117790.
International Search Report (with English translation) issued in International (PCT) Application No. PCT/JP2012/051643 on Feb. 28, 2012.
Written Opinion of the International Searching Authority (with English translation) issued in (PCT) Application No. PCT/JP2012/051643 on Feb. 28, 2012.
Japanese Office Action issued Apr. 25, 2014 in corresponding Japanese Application No. 2011-074206 with English translation.
Extended European Search Report issued Oct. 7, 2014 in corresponding European Application No. 12765834.2.
Machine translation of JP2007321630A (published Dec. 2007) from JPO.
Chinese Office Action issued Oct. 29, 2014 in corresponding Chinese Patent Application No. 201280015162.1 with English translation.
Opposition issued Oct. 14, 2016 in corresponding Japanese Application No. 2015-117787.
Notice of Reasons for Rescission issued Nov. 25, 2016 in corresponding Japanese Application No. 2014-219739, with English translation.
Notice of Reasons for Rescission issued Nov. 25, 2016 in corresponding Japanese Application No. 2015-117787, with English translation.

* cited by examiner

ROTOR OF ROTARY MACHINE AND ROTARY MACHINE

TECHNICAL FIELD

The present invention relates to a rotor of a rotary machine and a rotary machine.

Priority is claimed on Japanese Patent Application No. 2011-74206, filed Mar. 30, 2011, the content of which is incorporated herein by reference.

BACKGROUND ART

Recently, in steam-power generation using a steam turbine, electricity is usually generated at 600° C. or less. In many cases, main components such as a turbine rotor and a rotor vane constituting the steam turbine and used under these conditions are formed of, for example, high Cr-steel (high-chrome steel and ferritic heat resistant steel) such as 12Cr steel.

Incidentally, in recent years, there has been a demand for generating electricity at conditions in which the steam is 700° C. or more in order to meet requirements for a reduction in the discharge of $CO_2$ and further improvements in thermal efficiency. However, due to the insufficient high-temperature strength of the main components, it is not desirable to use ferritic heat resistant steel under these conditions.

Therefore, in order to ensure a higher high-temperature strength, a Ni-based alloy (nickel base alloy) is used for the main components. However, when the Ni-based alloy is used, there are disadvantages in that the main components may not be easily made in large sizes and the cost may increase.

In Patent Document 1 below, in order to both allow an increase in size and suppress cost of the turbine rotor, a turbine rotor is formed by joining a first member formed of a Ni-based alloy to a second member formed of high Cr-steel by welding. Then, the strength of the joint portion is ensured by using a Ni-based alloy with a specific composition.

PRIOR ART DOCUMENT

Patent Document

Patent Document 1: PCT International Publication WO 2009/154243

SUMMARY OF THE INVENTION

Problem to be Solved by the Invention

Incidentally, the Ni-based alloy generally has a low thermal conductivity and a large linear expansion coefficient. For this reason, during the start-up of the steam turbine, the outside of the turbine rotor (the Ni-based alloy) increases in temperature and thermally expands so as to be larger than the inside thereof, thereby causing a problem in that excessive stress is generated inside the turbine rotor.

On the other hand, when the turbine rotor is warmed up slowly so that the temperature thereof gradually increases as a whole, the generation of thermal stress may be suppressed. However, there is a problem in that rapid start-up of the steam turbine is inhibited.

The invention is made in view of such circumstances, and it is an object of the invention to allow rapid start-up of the rotary machine and to suppress the thermal stress generated in the rotor.

Means for Solving the Problems

In order to accomplish the above-described object, the invention adopts the following means.

That is, according to the invention, there is provided a rotor of a rotary machine of which an outer peripheral portion extending along an axis is surrounded by a stator and in which a hydraulic fluid circulates in a passageway defined between the stator and the outer peripheral portion, the rotor including: a plurality of rotor members that are joined to each other in the axial direction in which the axis extends, wherein a first rotor member which is included in the plurality of rotor members and which is located in a hydraulic fluid injection portion of the passageway is formed of an Ni-based alloy, and the inside of the first rotor member is hollow throughout the entire length in the axial direction.

In this way, since the inside of the first rotor member which is formed of the Ni-based alloy is hollow throughout its entire length in the axial direction, the thermal capacity of the first rotor member becomes smaller than that of the case where the inside is solid. Accordingly, when the rotary machine is rapidly started up, a difference in the temperature which is generated between the outside and the inside of the inner portion of the first rotor member is suppressed, so that the temperature of the first rotor member increases as a whole. Accordingly, it is possible to suppress the thermal stress which is generated inside the first rotor member. Thus, the rotary machine may be rapidly started up and the thermal stress generated in the rotor may be suppressed.

Further, the plurality of rotor members may include a second rotor member that is adjacent to the first rotor member in the axial direction and is formed of high Cr-steel.

In this way, since the plurality of rotor members include the second rotor member which is adjacent to the first rotor member in the axial direction and is formed of high Cr-steel, it is possible to suppress an increase in the cost of the rotor compared to the case where the entire rotor is formed of the Ni-based alloy. Furthermore, since part of the rotor is formed of high Cr-steel which is more easily molded than Ni-based alloy, the rotor may be easily manufactured.

Further, the first rotor member may be formed so that the thickness of the center portion in the axial direction is greater than or equal to the thickness of the end portion in the axial direction and the value of the ratio between the inner diameter and the outer diameter at the center portion in the axial direction is greater than or equal to ½.

In this way, it is possible to further suppress a difference in the temperature which is generated between the outside and the inside of the inner portion of the first rotor member, and further suppress the thermal stress generated inside the first rotor member. Further, it is possible to ensure the strength necessary for the first rotor member.

Further, a plurality of the hydraulic fluid injection portions may be formed, and the inner diameters of at least two or more of the plurality of hydraulic fluid injection portions may be different from each other in the first rotor member.

In this way, it is possible to adjust the temperature distribution for each hydraulic fluid injection portion.

Further, the inner diameters of a plurality of portions in the axial direction may be different from each other in the first rotor member.

In this way, it is possible to adjust the temperature distribution in a plurality of portions in the axial direction.

Further, in at least part of the first rotor member in the axial direction, a hole may be formed in a tapered shaped so that the inner diameter gradually decreases toward one end side of the rotor member from the other end side.

In this way, it is possible to adjust the temperature of the first rotor member in the axial direction.

Further, the Ni-based alloy may include 0.15 wt % or less of C, 1 wt % or less of Si, 1 wt % or less of Mn, 5 to 15 wt % of Cr, 17 to 25 wt % of including one or two or more of Mo, W, and Re; Mo+(W+Re)/2, 0.2 to 2 wt % of Al, 0.5 to 4.5 wt % of Ti, 10 wt % or less of Fe, including one or two of 0.02 wt % or less of B and 0.2 wt % or less of Zr, 2.5 to 7.0 at % of Al+Ti, and the remainder of Ni and inevitable impurities.

Further, the Ni-based alloy may include 0.15 wt % or less of C, 1 wt % or less of Si, 1 wt % or less of Mn, 5 to 20 wt % of Cr, 17 to 26 wt % of Mo, 17 to 27 wt % of Mo+(W+Re)/2, 0.1 to 2 wt % of Al, 0.1 to 2 wt % of Ti, 10 wt % or less of Fe, 0.02 wt % or less of B, 0.2 wt % or less of Zr, 1 to 5.5 at % of Al+Ti, and the remainder of Ni and inevitable impurities.

Further, the Ni-based alloy may include 0.15 wt % or less of C, 1 wt % or less of Si, 1 wt % or less of Mn, 5 to 20 wt % of Cr, 17 to 27 wt % of including one or two or more of Mo, W, and Re; Mo+(W+Re)/2, 0.1 to 2 wt % of Al, 0.1 to 2 wt % of Ti, 10 wt % or less of Fe, 0.001 to 0.02 wt % of B, 0.001 to 0.2 wt % of Zr, 1.5 wt % or less of Nb+Ta/2, 5 wt % or less of Co, and the remainder of Ni and inevitable impurities.

Further, the Ni-based alloy may include 0.15 wt % or less of C, 1 wt % or less of Si, 1 wt % or less of Mn, 5 to 20 wt % of Cr, 10 wt % or less of W, 5 to 20 wt % of including one or two or more of Mo, W, and Re; Mo+(W+Re)/2, 0.1 to 2.5 wt % of Al, 0.10 to 0.95 wt % of Ti, 4 wt % or less of Fe, 0.001 to 0.02 wt % of B, 0.001 to 0.2 wt % of Zr, 1.5 wt % or less of Nb+Ta/2, 2.0 to 6.5 at % of Al+Ti+Nb+Ta, and the remainder of Ni and inevitable impurities.

Further, the Ni-based alloy may include 0.005 to 0.1 wt % of C, 8 to 15 wt % of Cr, 5 to 20 wt % of W, 1 to 7 wt % of Mo, 0.5 to 1.0 wt % of Al, 1.0 to 2.5 wt % of Ti, and the remainder of Ni and inevitable impurities.

Further, the Ni-based alloy may include 0.005 to 0.15 wt % of C, 8 to 22 wt % of Cr, 5 to 30 wt % of Co, 5 to 20 wt % of W, 1 to 9 wt % of Mo, 0.1 to 2.0 wt % of Al, 0.3 to 2.5 wt % of Ti, 0.015 wt % or less of B, 0.01 wt % or less of Mg, and the remainder of Ni and inevitable impurities.

That is, when the first rotor member is formed of the Ni-based alloy with the abovementioned compositions, it is possible to ensure the strength of the joint portion with the second rotor member formed of the high Cr-steel.

Furthermore, according to the invention, there is provided a rotary machine including: a rotor of one of the above-described rotary machines and a stator which surrounds the rotor and in which a hydraulic fluid is injected into a passageway defined between the stator and the rotor.

In this way, even when the Ni-based alloy is used under conditions in which the hydraulic fluid is comparatively hot, the rotary machine may be rapidly started up and the thermal stress generated in the rotor may be suppressed. Accordingly, satisfactory running performance may be obtained and damage to the rotor may be prevented. Then, since the hydraulic fluid is set to a comparatively high temperature, requirements for a reduction in the discharge of $CO_2$ or further improvements in thermal efficiency may be sufficiently handled.

Advantageous Effect of the Invention

According to the rotor of the rotary machine of the invention, it is possible to rapidly start up the rotary machine and suppress the thermal stress generated in the rotor.

Further, according to the rotary machine of the invention, it is possible to obtain a satisfactory running performance and prevent damage to the rotor.

MODE FOR CARRYING OUT THE INVENTION

Figure 1:
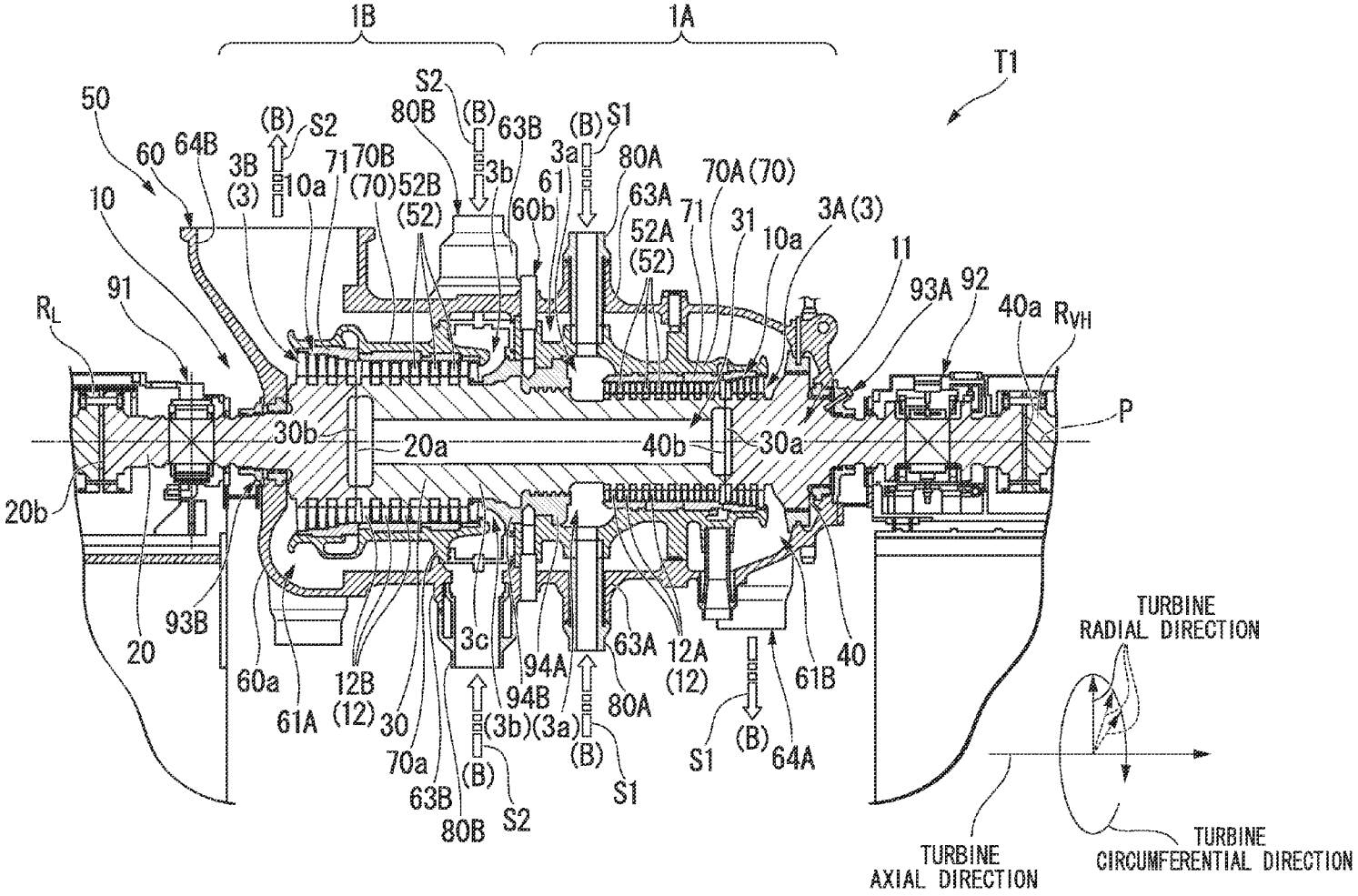
FIG. 1 is a cross-sectional view illustrating a schematic configuration of a high and intermediate pressure turbine T1 according to a first embodiment of the invention, and a meridian cross-sectional view including the axis P of the high and intermediate pressure turbine T1.

Hereinafter, embodiments of the invention will be described by referring to the drawings.

(First Embodiment)

FIG. 1 is a cross-sectional view illustrating a schematic configuration of a high and intermediate pressure turbine (a rotary machine) T1 according to a first embodiment of the invention, and a meridian cross-sectional view including the axis P of the high and intermediate pressure turbine T1. Furthermore, in the following description, the extension direction of the axis P is referred to as the turbine axial direction (the axial direction), the circumferential direction of the axis P is referred to as the turbine circumferential direction, and the radial direction of the axis P is referred to as the turbine radial direction.

As shown in FIG. 1, in the high and intermediate pressure turbine T1, a high pressure turbine (a rotary machine) 1A is installed at one side of the turbine axial direction, and an intermediate pressure turbine (a rotary machine) 1B is installed at the other side of the turbine axial direction.

The high and intermediate pressure turbine T1 includes a rotor 10 and a stator 50.

The rotor 10 includes a shaft body 11 which is rotatably supported and a plurality of rotor vane rows 12 (12A and 12B) which are formed in the shaft body 11.

The shaft body 11 penetrates the stator 50 in the turbine axial direction, and both ends in the turbine axial direction are supported by bearing units 91 and 92 which are disposed outside the stator 50. The other configurations of the shaft body 11 will be described in detail.

The plurality of rotor vane rows 12 (12A and 12B) are formed in a manner such that a plurality of rotor vanes restrained in the outer periphery of the shaft body 11 is arranged in the turbine circumferential direction. The plurality of rotor vane rows 12A is arranged in the high pressure turbine 1A, and the plurality of rotor vane rows 12B is arranged in the intermediate pressure turbine 1B.

The stator 50 includes an external casing 60, an internal casing 70 (70A and 70B), and a stator vane row 52 (52A and 52B).

The external casing 60 includes an interior wall 60*a* which defines an internal space 61 at the outside and a partition wall 60*b* which divides the internal space 61 into two parts in the turbine axial direction. The partition wall 60*b* is disposed substantially at the center of the internal space 61 in the turbine axial direction, and divides the internal space 61 into a high pressure turbine chamber 61A which is disposed at one side in the turbine axial direction and an intermediate pressure turbine chamber 61B which is disposed at the other side in the turbine axial direction.

In the high pressure turbine 1A, the interior wall 60*a* of the external casing 60 is provided with a plurality of injection nozzles 63A which is formed at the other side in the turbine axial direction and a discharging nozzle 64A which is formed at one side in the turbine axial direction. Further, in the intermediate pressure turbine 1B, the interior wall 60*a* is provided with a plurality of injection nozzles 63B which is formed at one side in the turbine axial direction and a discharging nozzle 64B which is formed at the other side in the turbine axial direction.

A rotor 10 is inserted through the external casing 60, and both ends of the rotor 10 (the shaft body 11) protrude from both ends of the interior wall 60*a* in the turbine axial direction.

Furthermore, the gaps which are formed between the interior wall 60*a* and both ends of the rotor 10 are sealed by sealing units 93A and 93B. Further, the gaps which are formed between the partition wall 60*b* and the center of the rotor 10 are sealed by sealing members 94A and 94B.

The internal casing 70 (70A and 70B) is a cylindrical member of which both ends are opened, and which includes a stator vane holding ring 71 which holds the stator vane row 52 (52A and 52B) in the inner peripheral portion.

The internal casing 70A is disposed in the high pressure turbine 1A, and the internal casing 70B is disposed in the intermediate pressure turbine 1B. The internal casings 70A and 70B are restrained by the inner wall of the interior wall 60*a* and the partition wall 60*b* of the external casing 60. The internal casings 70A and 70B are inserted through the rotor 10 so as to surround the outer periphery 10*a* of the rotor 10, and an annular passageway (a passageway) 3 (3A and 3B) extends in the turbine axial direction between the outer periphery 10*a* of the rotor 10 and the stator vane holding ring 71.

The other end opening portion at the other side of the internal casing 70A in the turbine axial direction abuts on the partition wall 60*b* so as to be blocked and the gap between the other end opening portion and the rotor 10 is sealed by the seal member 94A.

The other end opening portion of the internal casing 70A defines a manifold (a hydraulic fluid injection portion) 3*a* which extends in the turbine circumferential direction and communicates with the annular passageway 3 between the sealing member 94A and the outer periphery of the shaft body 11. The manifold 3*a* communicates with a connecting pipe 80A which is inserted into each injection nozzle 63A and is air-tightly connected to the internal casing 70A, and high pressure steam (hydraulic fluid) S1 (about 700° C.) is supplied from a boiler B through the connecting pipe 80A. The manifold 3*a* introduces the high pressure steam S1 into the annular passageway 3 and the high pressure steam S1 supplied to the high pressure turbine 1A first contacts the rotor 10 in the manifold 3*a*. That is, in the running high pressure turbine 1A, the portion where the manifold 3*a* is exposed is the hottest among the portions of the rotor 10.

Furthermore, one end opening portion of the internal casing 70A is opened toward one side in the turbine axial direction.

The opening portions of both ends of the internal casing 70B are each opened in the turbine axial direction. A flange portion 70*a*, which extends in a flange shape from the outer peripheral portion of the internal casing 70, is formed at one side of the internal casing 70B in the turbine axial direction, and the flange portion 70*a* is connected to the inner wall of the interior wall 60*a*, so that a manifold 3*b* is defined around the one end opening portion. Intermediate pressure steam (hydraulic fluid) S2 (about 700° C.) is supplied from the boiler B to the manifold 3*b* through a connecting pipe 80B which is inserted to each injection nozzle 63B.

On the other hand, in the internal casing 70B, one side of the shaft body 11 in the turbine axial direction is covered by the sealing member 94B. That is, the intermediate pressure steam S2 which is supplied to the manifold 3*b* is introduced into the annular passageway 3B along the sealing member 94B, and the exposure portion (the hydraulic fluid injection portion) 3*c* from the sealing member 94B in the rotor 10 becomes a portion where the intermediate pressure steam S2 first contacts. That is, in the running intermediate pressure turbine 1B, the exposure portion 3*c* from the sealing member 94B becomes the hottest among the portions of the rotor 10.

The plurality of stator vane rows 52 (52A and 52B) is formed in a manner such that the stator vanes restrained in the stator vane holding ring 71 of the internal casing 70 (70A and 70B) are arranged in the turbine circumferential direction.

The stator vane row 52A and the rotor vane row 12A are alternately arranged from the other side in the turbine axial direction toward one side in the annular passageway 3A of the high pressure turbine 1A. The stator vane row 52B and the rotor vane row 12B are alternately arranged from one side in the turbine axial direction toward the other side in the annular passageway 3B of the intermediate pressure turbine 1B.

Figure 2:
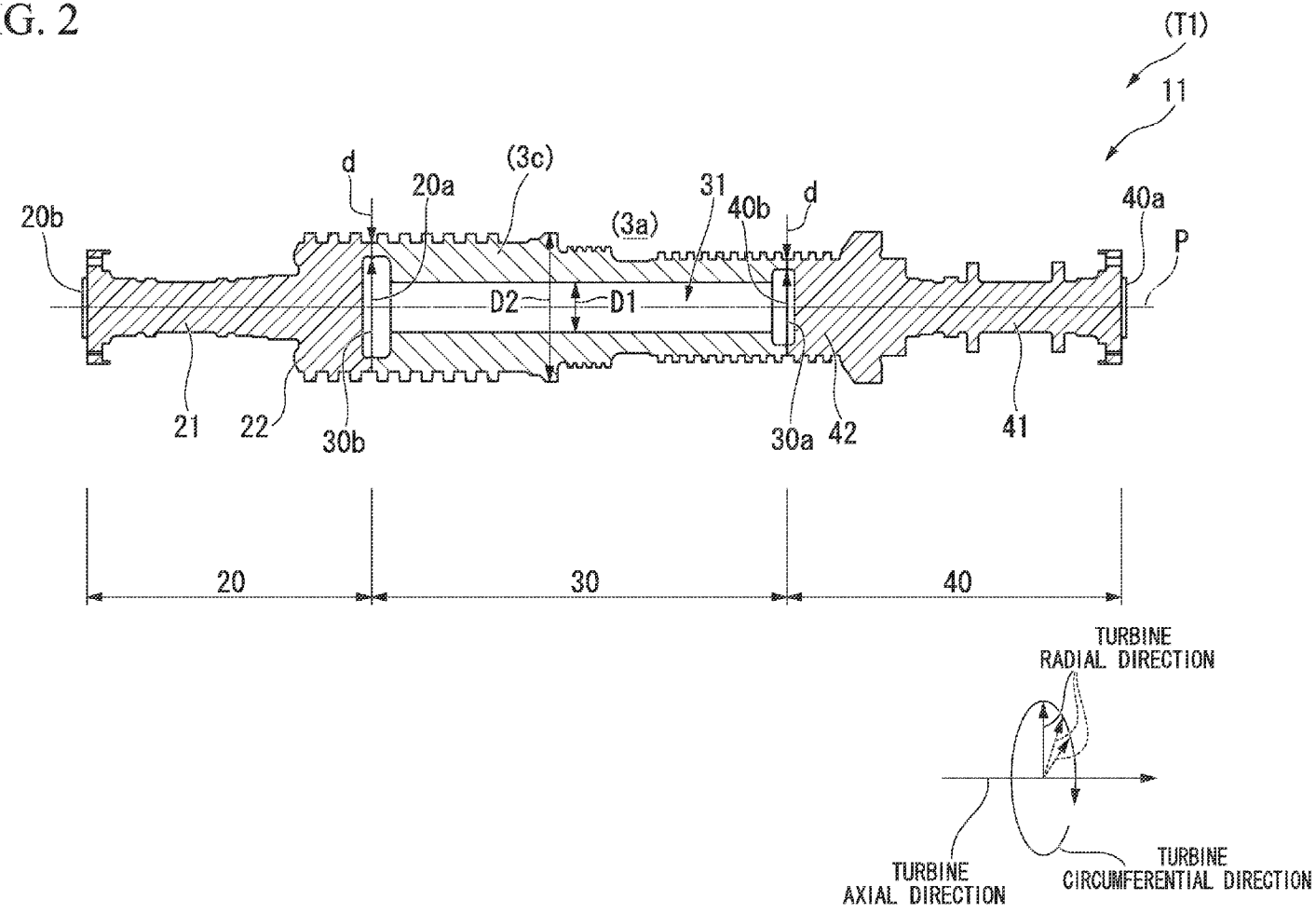
FIG. 2 is an enlarged cross-sectional view illustrating a shaft body 11 according to an embodiment of the invention.

FIG. 2 is an enlarged cross-sectional view illustrating the shaft body 11.

As shown in FIG. 2, the shaft body 11 is formed by joining the rotor members 20, 30, and 40 to each other in the turbine axial direction. More specifically, the rotor members 20, 30, and 40 are joined to each other in the above-described order while each axis overlaps the axis P so as to be formed in a shaft shape as a whole. As also shown in FIG. 2, a number of vane rows 12 of the rotor member 30 is greater than a number of vane rows 12 of each of the rotor members 20 and 40, and a number of vane rows 12 on each end side of the rotor member 30 is greater than the number of vane rows 12 of each of the rotor members 20 and 40.

The rotor member (the second rotor member) 20 includes a small diameter portion 21 which is formed with a relatively small diameter and a large diameter portion 22 which is formed with a relatively large diameter.

In the large diameter portion 22, one end portion 20*a* at one side in the turbine axial direction is depressed in a dish shape, and the other end portion 20*b* is connected to, for example, the end portion of the rotor $R_L$ of the low pressure turbine (see FIG. 1).

The rotor member (the second rotor member) 40 includes a small diameter portion 41 which is formed with a relatively small diameter and a large diameter portion 42 which is formed with a relatively large diameter.

In the rotor member 40, the other end portion 40*b* at the other side of the rotor member 40 in the turbine axial direction is depressed in a dish shape, and one end portion 40*a* is connected to, for example, the end portion of the rotor $R_{VH}$ of the ultra high pressure turbine (see FIG. 1).

The rotor members 20 and 40 are formed of, for example, high Cr-steel and are formed by, for example, forging. As the high Cr-steel, for example, the compositions of 1-1 and 1-2 shown in Table 1 below may be preferably used. In the high Cr-steel with such a composition, the average linear expansion coefficient from room temperature to 700° C. is approximately from $11.2\times10^{-6}$/° C. to $12.4\times10^{-6}$° C.

Furthermore, high Cr-steel with a composition other than that in Table 1 may also be used.

TABLE 1

| | 1-1 | 1-2 |
|---|---|---|
| C | ≤0.10% | 0.08~0.25% |
| Si | ≤0.10% | ≤0.10% |
| Mn | 0.05~1.5% | ≤0.10% |
| Ni | ≤1.5% | 0.05~1.0% |
| Cr | 7~10% | 10~12.5% |
| Mo | (referred to below) | 0.6~1.9% |
| W | (referred to below) | 1.0~1.95% |
| V | 0.10~0.30% | 0.10~.035% |
| Nb | 0.02~0.10% | 0.02~0.10% |

TABLE 1-continued

| | 1-1 | 1-2 |
|---|---|---|
| N | 0.01~0.07% | 0.01~0.08% |
| Al | ≤0.02% | |
| B | | 0.001~0.01% |
| Co | | 2.0~8.0% |
| Fe | Bal. | Bal. |
| Other conditions | Containing amount inside straight lines connecting A(1.75%Mo, 0.0%W), B(1.75%Mo, 0.5%W), C(1.53%Mo, 0.5%W), D(1.3%Mo, 1.0%W), E(2.0%Mo, 1.0%W), F(2.5%Mo, 0.5%W), G(2.5%Mo, 0.0%W), and A | |

Furthermore, % in Table 1 indicates the weight %.

In the rotor member (the first rotor member) 30, both end portions (the joint end portion) 30*a* and 30*b* in the turbine axial direction are depressed in a dish shape.

The rotor member 30 is formed of a Ni-based alloy, and has comparatively low thermal conductivity and a high linear expansion coefficient. As the Ni-based alloy, for example, the compositions of 2-1, 2-2, 2-3, 2-4, 2-5, and 2-6 shown in Table 2 below may be preferably used. In the Ni-based alloys with such compositions, the average linear expansion coefficient from room temperature to 700° C. is approximately from $12.4\times10^{-6}$/° C. to $14.5\times10^{6}$° C., and is suppressed so as to be lower than that of Ni-based alloys with other compositions.

Furthermore, Ni-based alloy with a composition other those in than Table 2 may also be used.

TABLE 2

| | 2-1 | 2-2 | 2-3 | 2-4 | 2-5 | 2-6 |
|---|---|---|---|---|---|---|
| C | ≤0.15% | ≤0.15% | ≤0.15% | ≤0.15% | 0.005~0.1% | 0.005~0.15% |
| Si | ≤1% | ≤1% | ≤1% | ≤1% | | |
| Mn | ≤1% | ≤1% | ≤1% | ≤1% | | |
| Cr | 5~15% | 5~20% | 5~20% | 5~20% | 8~15% | 8~22% |
| Mo | (referred to below) | 17~26% | (referred to below) | (referred to below) | 1~7% | 1~9% |
| W | (referred to below) | (referred to below) | (referred to below) | ≤10% | 5~20% | 5~20% |
| Re | (referred to below) | (referred to below) | (referred to below) | (referred to below) | | |
| Al | 0.2~2% | 0.1~2% | 0.1~2% | 0.1~2.5% | 0.5~1.0% | 0.1~2.0% |
| Ti | 0.5~4.5% | 0.1~2% | 0.1~2% | | | |
| | 0.10~0.95% | 1.0~2.5% | 0.3~2.5% | | | |
| Nb | | | (referred to below) | (referred to below) | | |
| Ta | | | (referred to below) | (referred to below) | | |
| B | ≤0.02% | ≤0.02% | 0.001~0.02% | 0.001~0.02% | | ≤0.015% |
| Zr | ≤0.2% | ≤0.2% | 0.001~0.02% | 0.001~0.2% | | |
| Fe | ≤10% | ≤10% | ≤10% | ≤4% | | |
| Ni | Bal. | Bal. | Bal. | Bal. | Bal. | Bal. |
| Co | | | ≤5% | | | 5~30% |
| Mg | | | | | | ≤0.01% |
| Other conditions | Mo + (W + Re)/2:17~25% in one or two or more of Mo, W and Re | 17 ≤ Mo + (W + Re)/2 ≤ 27% | Mo + (W + Re)/2:17~27% in one or two or more of Mo, W and Re | Mo + (W + Re)/2:5~20% in one or two or more of Mo, W and Re | | |
| | at. % of Al + Ti is 2.5~7.0% | at. % of Al + Ti is 1~5.5% | Nb + Ta/2 ≤ 1.5% | Nb + Ta/2 ≤ 1.5% | | |
| | B and Zr Contains any one or two or more. | | | at. % of Al + Ti + Nb + Ta is 2.0~6.5% | | |

Furthermore, % in Table 2 indicates the weight %.

One end portion 30*a* of the rotor member 30 is joined to the other end portion 40*b* of the rotor member 40 by welding in an abutting state. Further, the other end portion 30*b* of the rotor member 30 is joined to one end portion 20*a* of the rotor member 20 by welding in an abutting state.

With regard to the joint portions of both end portions 30*a* and 30*b* of the rotor member 30 in the turbine axial direction, it is desirable that the thickness d be set as small as possible on the condition that the necessary strength is ensured while maintaining the running state of the high and intermediate pressure turbine T1.

As shown in FIG. 2, the inside of the rotor member 30 is formed so as to be hollow. More specifically, a hole 31 with a constant inner diameter D1 extends in the turbine axial direction on the axis P, and one end portion 30*a* and the other end portion 30*b* communicate with each other. That is, the thermal capacity of the rotor member 30 becomes smaller than that of the case where the rotor member 30 is solid (i.e., the case where the hole 31 is not formed).

The thickness of the rotor member 30 is formed so that the center portion in the turbine axial direction is greater than or equal to each thickness d of both end portions in the turbine axial direction and the value of the ratio of the inner diameter D1 with respect to the outer diameter D2 at the center portion in the turbine axial direction is greater than or equal to ½.

Subsequently, operation of the high and intermediate pressure turbine T1 with the above-described configuration will be described with reference to the drawings.

First, when the high and intermediate pressure turbine T1 is started up, the high pressure steam S1 flows into the high pressure turbine 1A and the intermediate pressure steam S2 flows into the intermediate pressure turbine 1B.

As shown in FIG. 1, for example, in the high pressure turbine 1A, the high pressure steam S1 which passes through the ultra high pressure turbine (not shown) and is reheated by the boiler B is supplied to the manifold 3*a* through the connecting pipe 80A. Then, the high pressure steam S1 is introduced into the annular passageway 3A along the rotor member 30, and sequentially flows through the rotor vane row 12A and the stator vane row 52A, thereby applying rotational force to the rotor 10. The high pressure steam S1 which passes through the annular passageway 3A is discharged from the high pressure turbine 1A through the discharge nozzle 64A and sent to the boiler B.

On the other hand, for example, in the intermediate pressure turbine 1B, the intermediate pressure steam S2 which is discharged from the high pressure turbine 1A and is reheated by the boiler B is supplied to the manifold 3*b* through the connecting pipe 80B.

Then, the intermediate pressure steam S2 is introduced from the manifold 3*b* into the annular passageway 3B along the sealing member 94B, and sequentially flows through the rotor vane row 12B and the stator vane row 52B in the annular passageway 3B, thereby applying rotational force to the rotor 10. The intermediate pressure steam S2 which passes through the annular passageway 3B is discharged from the intermediate pressure turbine 1B through the discharge nozzle 64B and sent to the boiler (not shown).

At this time, since the inside of the rotor member 30 in the rotor 10 is formed so as to be hollow so that the thermal capacity is small, it is difficult for a difference in temperature between the outside and the inside in the inner portion (more specifically, the thick portion) of the rotor member 30 to arise.

In other words, since the rotor member 30 is formed so as to be hollow, the distance of the thermal transmission path from the outer peripheral end of the rotor member 30 to the inner peripheral end thereof is shorter than that of the case where the rotor member 30 is solid, and the heat which is transmitted from the high pressure steam S1 to the outer peripheral end of the rotor member 30 is rapidly conducted (reaches) to the inner peripheral end of the rotor member 30. For this reason, the temperature gradient in the turbine radial direction inside the rotor member 30 is gentle, and the temperatures of the outside and the inside of the inner portion of the rotor member 30 are equal to each other.

A difference in the thermal growth between the outside and the inside of the rotor member 30 decreases in proportion to a difference in the temperature which is generated outside and inside of the inner portion of the rotor member 30. For this reason, it is possible to largely suppress the thermal stress which is generated inside the rotor member 30.

When this state is continued, the temperature of the entire rotor member 30 increases to the running temperature of the high and intermediate pressure turbine T1.

Then, the high and intermediate pressure turbine T1 changes from the start-up state to the normal state. After changing to the normal state, the rotor member 30 rotates after the temperature becomes constant.

As described above, according to the high and intermediate pressure turbine T1, since the inside of the rotor member 30 which is formed of the Ni-based alloy is formed so as to be hollow throughout the entire length in the turbine axial direction, the thermal capacity of the rotor member 30 becomes smaller than that of the case where the inside is solid. Accordingly, when the high and intermediate pressure turbine T1 is rapidly started up, a difference in the temperature which is generated between the outside and the inside of the inner portion of the rotor member 30 is suppressed, and the temperature of the rotor member 30 increases as a whole. Accordingly, it is possible to suppress the thermal stress which is generated inside the rotor member 30. Thus, the high and intermediate pressure turbine T1 may be rapidly started up and the thermal stress generated in the rotor 10 may be suppressed.

Further, since the shaft body 11 is adjacent to the rotor member 30 in the turbine axial direction and the rotor members 20 and 40 which are formed of high Cr-steel are provided, it is possible to suppress the cost of the rotor 10 compared to the case where the entire shaft body 11 is formed of Ni-based alloy. Furthermore, since part of the shaft body 11 is formed of high Cr-steel which is more easily molded than the Ni-based alloy, the rotor 10 may be easily manufactured.

Further, since the rotor member 30 is formed of Ni-based alloy with the composition shown in Table 2, the average linear expansion coefficient from room temperature to 700° C. becomes smaller than that of Ni-based alloy with other compositions. Accordingly, since thermal growth hardly occurs in the rotor member 30 compared to Ni-based alloys with other compositions, it is possible to further suppress the thermal stress which is generated inside the rotor member 30.

Further, since the rotor members 20 and 40 are formed of high Cr-steel with the composition shown in Table 1 and the rotor member 30 is formed of Ni-based alloy with the composition shown in Table 2, a difference in the linear expansion coefficient is decreased. Accordingly, it is possible to ensure the strength of the joint portions of the rotor members 20 and 40 and the rotor member 30.

Further, the thickness of the rotor member 30 is formed so as to be greater than or equal to ½ of the value of the ratio of the inner diameter D1 with respect to the outer diameter D2 at the center portion in the turbine axial direction. Thus, it is possible to further suppress a difference in the temperature which is generated between the outside and the inside of the inner portion of the rotor member 30, and further suppress the thermal stress which is generated inside the rotor member 30. Further, the thickness of the rotor member 30 is formed so as to be greater than or equal to ½ of the value of the ratio of the inner diameter D1 with respect to the outer diameter D2 at the center portion in the turbine axial direction. Thus, it is possible to further suppress a difference in the temperature which is generated between the outside and the inside of the inner portion of the rotor member 30, and further suppress the thermal stress which is generated inside the rotor member 30. Further, the thickness of the rotor member 30 is formed so as to be greater than or equal to thickness d of both end portions in the turbine axial direction at the center portion in the turbine axial direction. Thus, it is possible to ensure the strength which is necessary for the rotor member 30.

Furthermore, since the high and intermediate pressure turbine T1 according to the invention includes the rotor 10, even when Ni-based alloy is used at steam conditions of 700° C. or more, the high and intermediate pressure turbine T1 may be rapidly started up and the thermal stress generated in the rotor 10 is suppressed. Accordingly, satisfactory running performance may be obtained, and the breakage of the rotor 10 may be prevented. Then, since the steam S1 and the steam S2 are set to a comparatively high temperature (about 700° C.), a demand for the reduction in the discharge amount of $CO_2$ or the further improvement in the thermal coefficient may be sufficiently handled.

(Second Embodiment)

Hereinafter, a second embodiment of the invention will be described by referring to the drawings. Furthermore, in the following description and the drawings used for the description, the same reference numerals will be given to the same components as the components described above, and the repetitive descriptions thereof will not be repeated.

Figure 3:
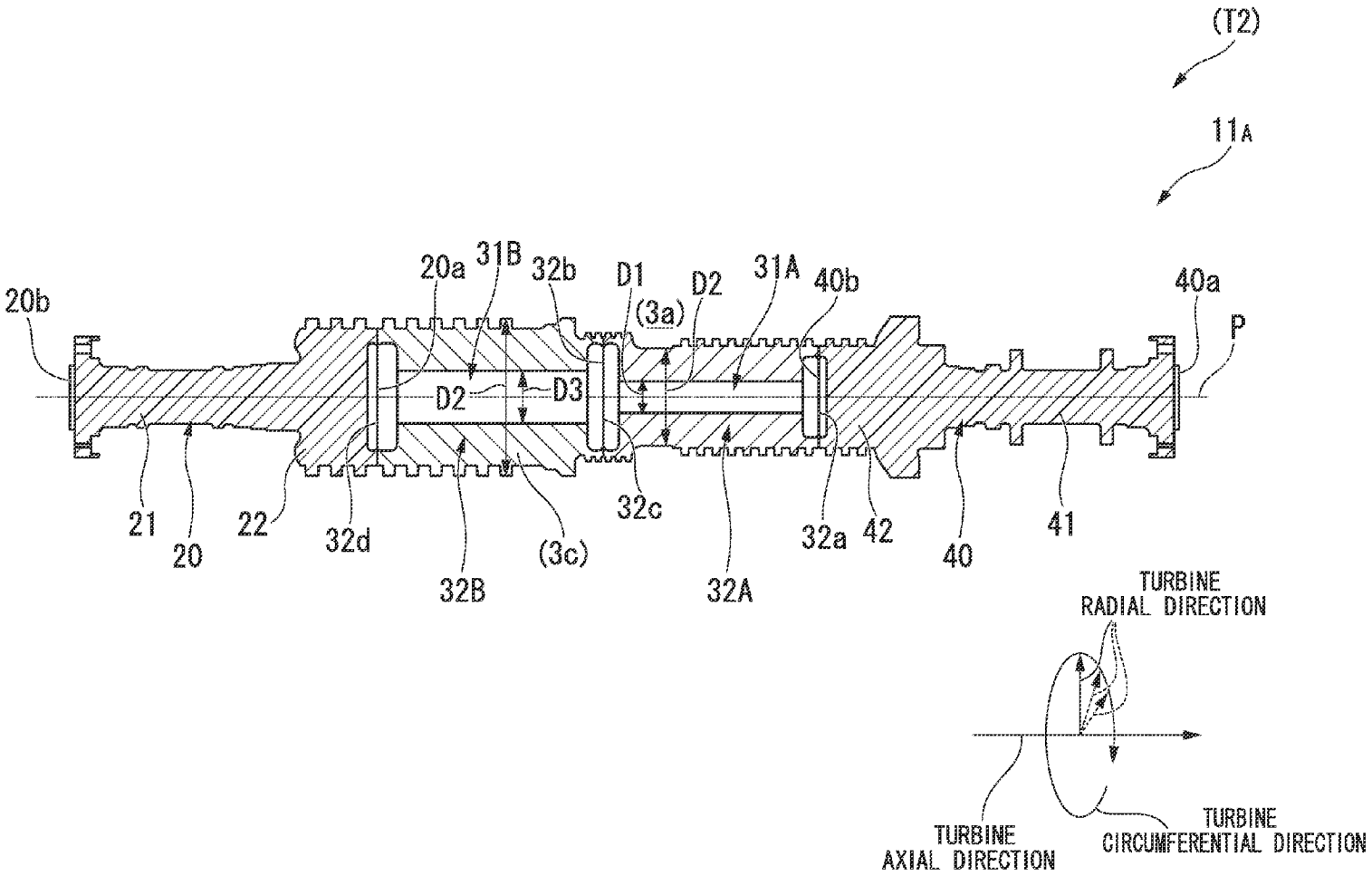
FIG. 3 is an enlarged cross-sectional view illustrating a shaft body 11A in a high and intermediate pressure turbine T2 according to a second embodiment of the invention.

FIG. 3 is an enlarged cross-sectional view illustrating a shaft body 11A in a high and intermediate pressure turbine (the rotary machine) T2 according to the second embodiment of the invention.

Compared to the configuration in which the shaft body 11 of the first embodiment includes the rotor member 30 which is integrally formed with the shaft body, as shown in FIG. 3, the shaft body 11A of the high and intermediate pressure turbine T2 according to this embodiment has a configuration in which rotor members (first rotor members) 32A and 32B are disposed at a position corresponding to the rotor member 30.

The rotor members 32A and 32B are formed of Ni-based alloy as in the case of the rotor member 30, and both end portions (joint end portions) 32*a*, 32*b*, 32*c*, and 32*d* are each depressed in a dish shape in the turbine axial direction. The inside of each of the rotor members 32A and 32B is formed so as to be hollow.

One end portion 32*a* of the rotor member 32A is joined to the other end portion 40*b* of the rotor member 40 (added since it is not shown) by welding in an abutting state.

One end portion 32*d* of the rotor member 32B is joined to one end portion 20*a* of the rotor member 20 (added since it is not shown) by welding in an abutting state.

Further, the other end portion 32*b* of the rotor member 32A and the other end portion 32*c* of the rotor member 32B are joined to each other by welding (common welding) in an abutting state.

In the rotor member 32A, a hole 31A with a constant inner diameter D1 extends in the turbine axial direction on the axis P. In the rotor member 32B, a hole 31B with a constant inner diameter D3 (≠the inner diameter D1) extends in the turbine axial direction on the axis P.

That is, the rotor members 32A and 32B are formed so as to have different inner diameters.

According to the high and intermediate pressure turbine T2, it is possible to obtain the main advantage of the first embodiment. Further, since the inner diameters (D1≠D3) are different from each other in the manifold 3*a* and the exposure portion 3*c* shown in FIG. 1, it is possible to adjust each temperature distribution of the manifold 3*a* and the exposure portion 3*c* (the high pressure turbine 1A and the intermediate pressure turbine 1B).

Furthermore, it is possible to obtain the main advantage of the first embodiment even when the rotor members 32A and 32B have the same inner diameter.

"Third embodiment"

Hereinafter, a third embodiment of the invention will be described by referring to the drawings. Furthermore, in the following description and the drawings used for the description, the same reference numerals will be given to the same components as the components described above, and the repetitive descriptions thereof will not be repeated.

Figure 4:
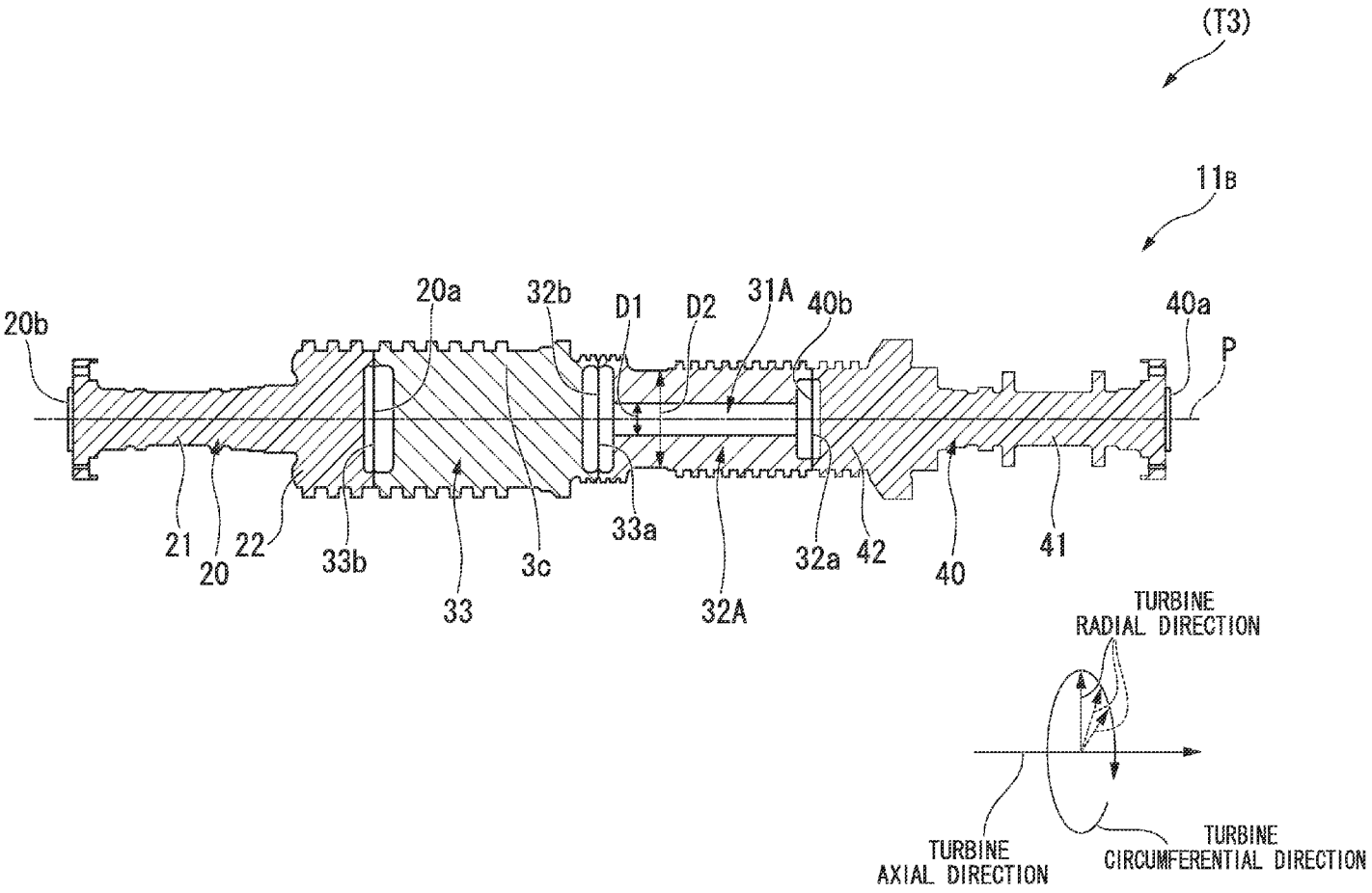
FIG. 4 is an enlarged cross-sectional view illustrating a shaft body 11B in a high and intermediate pressure turbine T3 according to a third embodiment of the invention.

FIG. 4 is an enlarged cross-sectional view illustrating a shaft body 11B in a high and intermediate pressure turbine (the rotary machine) T3 according to the third embodiment of the invention.

Compared to the configuration in which the shaft body 11A of the second embodiment includes the rotor member 32B with the hole 31B, as shown in FIG. 4, a shaft body 11B of the high and intermediate pressure turbine T3 according to this embodiment includes a solid rotor member 33 instead of the rotor member 32B.

The rotor member 33 is formed of an Ni-based alloy, where one end portion (the joint end portion) 33*a* is joined to the other end portion 32*b* of the rotor member 32A by welding in an abutting state and the other end portion 33*b* is joined to one end portion 20*a* of the rotor member 20 (added since it is not shown in the drawings) by welding in an abutting state.

According to the high and intermediate pressure turbine T3, it is possible to obtain the main advantages of the first embodiment and the second embodiment in the rotor member 32A. Further, since the inside of the rotor member 33 is solid, it is possible to improve the rigidity of the rotor member 33 in the intermediate pressure turbine 1B.

Furthermore, the inside of the rotor member 33 may be hollow (as in the case of the rotor member 32B), and the inside of the rotor member 32A may be formed so as to be solid.

"Fourth embodiment"

Hereinafter, a fourth embodiment of the invention will be described by referring to the drawings. Furthermore, in the following description and the drawings used for the description, the same reference numerals will be given to the same components as the components described above, and the repetitive descriptions thereof will not be repeated.

Figure 5:
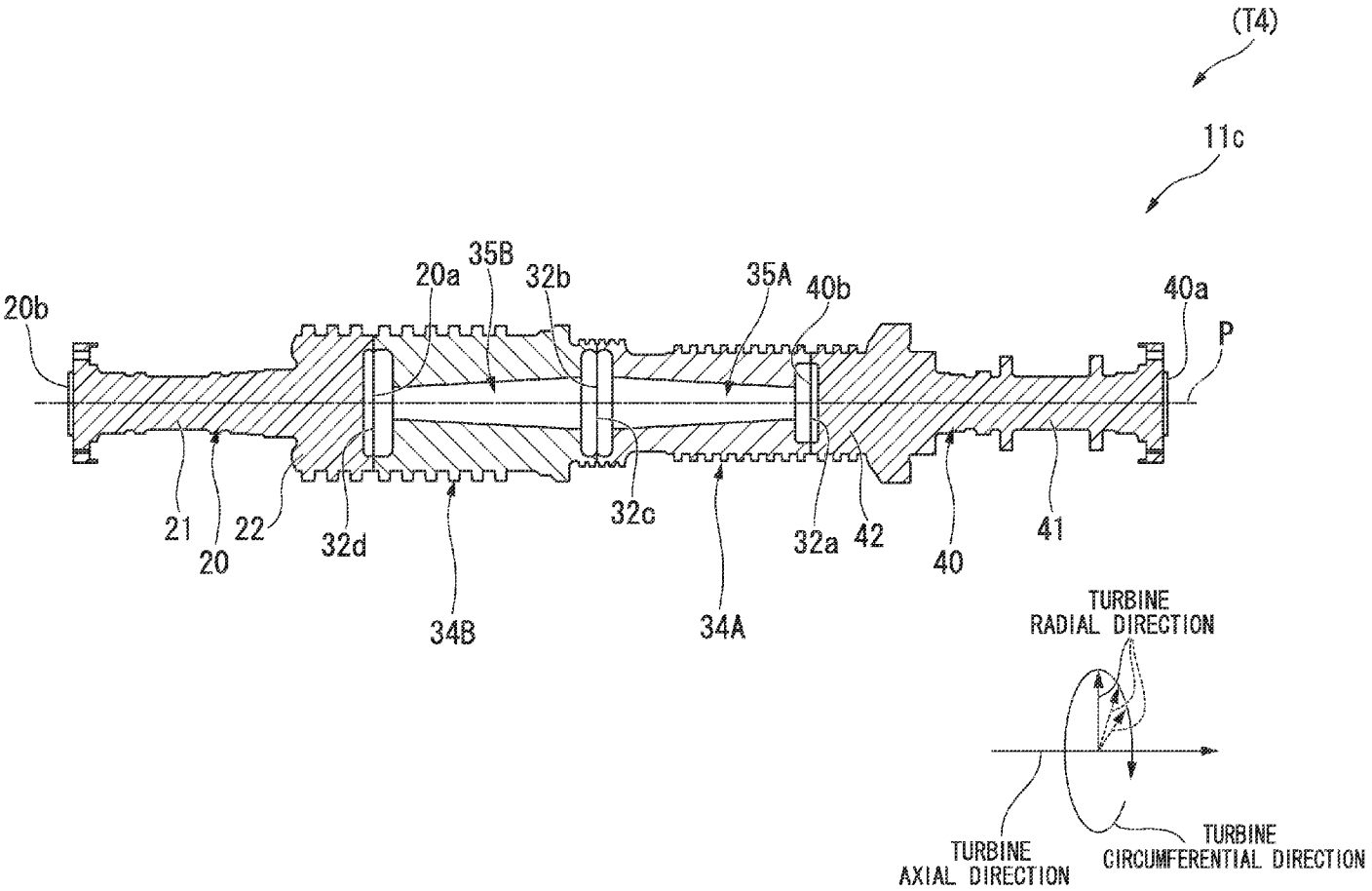
FIG. 5 is an enlarged cross-sectional view illustrating a shaft body 11C in a high and intermediate pressure turbine T4 according to a fourth embodiment of the invention.

FIG. 5 is an enlarged cross-sectional view illustrating a shaft body 11C in a high and intermediate pressure turbine (the rotary machine) T4 according to the fourth embodiment of the invention.

Compared to the configuration in which the shaft body 11A of the second embodiment includes the rotor members 32A and 32B having the holes 31A and 31B with constant inner diameters D1 and D3, as shown in FIG. 5, a shaft body 11C of the high and intermediate pressure turbine T4 according to this embodiment includes rotor members (first rotor members) 34A and 34B in which the inner diameters of the holes 35A and 35B respectively formed therein are different at each portion in the turbine axial direction.

The hole 35A of the rotor member 34A is formed in, for example, a tapered shape in which the inner diameter gradually decreases toward one end side of the rotor member 34A from the other end side in the turbine axial direction.

The hole 35B of the rotor member 34B is formed in, for example, a tapered shape in which the inner diameter gradually decreases from one end side of the rotor member toward the other end side in the turbine axial direction.

According to the high and intermediate pressure turbine T4, it is possible to obtain the main advantages of the first embodiment and the second embodiment. Further, since the inner diameters (the holes 35A and 35B) of the rotor members 34A and 34B are different at each portion in the turbine axial direction, it is possible to adjust the temperatures of the rotor members 34A and 34B (the high pressure turbine 1A and the intermediate pressure turbine 1B) in the turbine axial direction.

Furthermore, in the embodiment, the hole 35A is formed in a tapered shape in which the inner diameter gradually decreases from one end side of the rotor member 34A toward the other end side in the turbine axial direction, but may be formed so that the inner diameter gradually decreases toward one end side of the rotor member 34A from the other end side in the turbine axial direction. Further, a part of the hole 35A may have a portion with a constant inner diameter. Further, a portion may be formed in which the inner diameter of the hole 35A increases and then decreases in the turbine axial direction. The same applies to the hole 35B.

Further, as in this embodiment, the inner diameter of each hole of the first embodiment to the third embodiment may be changed in the turbine axial direction.

Furthermore, the operation sequences or all shapes, combinations, and the like of the components shown in the above-described embodiments are examples, and may be modified into various forms based on the design requirements and the like in the scope without departing from the spirit of the invention.

For example, in the above-described embodiments, each end portion of the rotor members 20, 30, 40, 32A, 32B, 33, 34A, and 34B in the turbine axial direction is formed in a dish shape, but may be depressed in other shapes in the turbine axial direction. Further, the end portion may be formed in a flat shape without being depressed in the turbine axial direction.

Further, in the above-described embodiments, a case has been described in which the invention is applied to the high and intermediate pressure turbines T1 to T4, but the invention may be applied to the turbine of another pressure range. Further, the invention may be applied to a rotary machine other than a turbine.

INDUSTRIAL APPLICABILITY

According to the rotor of the rotary machine of the invention, it is possible to rapidly start-up the rotary machine and suppress the thermal stress generated in the rotor.

DESCRIPTION OF REFERENCE NUMERALS

1A: high pressure turbine (rotary machine)
1B: intermediate pressure turbine (rotary machine)
3 (3A and 3B): annular passageway (passageway)
3*a*: manifold (hydraulic fluid injection portion)
3*c*: exposure portion (hydraulic fluid injection portion)
10: rotor
10*a*: outer periphery
20: rotor member (second rotor member)
30: rotor member (first rotor member)
30*a* and 30*b*: both end portions (joint end portion)
32A and 32B: rotor member (first rotor member)
32*a*, 32*b*: both end portions (joint end portion)
32*c*, 32*d*: both end portions (joint end portion)
33: rotor member (first rotor member)
33*a*: one end portion (joint end portion)
34A: rotor member (first rotor member)
34B: rotor member (first rotor member)
40: rotor member (second rotor member)
50: stator
P: axis
D: thickness
D1, D3: inner diameter
D2: outer diameter
S1: high pressure steam (hydraulic fluid)
S2: intermediate pressure steam (hydraulic fluid)
T1, T2, T3, T4: high and intermediate pressure turbine (rotary machine)

What is claimed is:

1. A steam turbine that is formed to have rotor members which are formed of different materials from each other and which are joined to each other in an axial direction, the steam turbine comprising:
- a first rotor member;
- a second rotor member;
- a casing which includes a guide portion through which a working fluid is guided and a discharge portion through which the working fluid is discharged;
- a plurality of sealing portions that seal the casing from outside; and
- a plurality of bearings,
- wherein the first rotor member is formed of an Ni-based alloy,
- wherein the first rotor member includes a hollow inside in the axial direction,
- wherein the guide portion is open radially inward towards the first rotor member,
- wherein the first rotor member includes a rotor vane across which the working fluid passes,
- wherein the second rotor member is formed of a material which is more easily molded than the Ni-based alloy,
- wherein an inside of the second rotor member is solid,
- wherein the second rotor member is joined to the first rotor member at one end of the first rotor member in the axial direction,
- wherein the discharge portion is open radially inward towards the second rotor member,
- wherein the second rotor member includes a rotor vane, across which the working fluid passes, on a joint side with the first rotor member,
- wherein one of the sealing portions and one of the bearings are disposed away from the joint side of the second rotor member,
- wherein the first rotor member and a joint portion on the joint side of the second rotor member with the first rotor member are disposed in a pressure range, wherein a number of vane rows of the first rotor member is greater than a number of vane rows of the second rotor member, and wherein an average linear expansion coefficient of the first rotor member in a temperature range of room temperature to 700° C. which becomes an operation region of the steam turbine is in a range of $12.4\times10^{-6}$/°C. to $14.5\times10^{-6}$/°C. and an average linear expansion coefficient of the second rotor member is in a range of $11.2\times10^{-6}$/°C. to $12.4\times10^{-6}$/°C.

2. The steam turbine according to claim 1, wherein a thickness of the first rotor member on a side thereof having the one end is greater than the thickness of the first rotor member on a side thereof having another end.

3. The steam turbine according to claim 1, wherein a thickness of the first rotor member becomes greater toward the one end and another end thereof.

4. The steam turbine according to claim 1, wherein the first rotor member includes a first portion in the axial direction on a side of the first rotor member having the one end and a second portion in the axial direction on a side of the first rotor member having another end, and wherein the hollow inside of the first rotor member is provided only on the second portion.

5. The steam turbine according to claim 1, wherein the first rotor member includes one or two elements of 0.15 wt % or less of C, 1 wt % or less of Si, 1 wt % or less of Mn, 5 to 15 wt % of Cr, 17 to 25 wt % of including one or two or more of Mo, W, and Re: Mo+(W+Re)/2, 0.2 to 2 wt % of Al, 0.5 to 4.5 wt % of Ti, 10 wt % or less of Fe, 0.02 wt % or less of B and 0.2 wt % or less of Zr; and the remainder of Ni and inevitable impurities, and wherein wt % of Al+Ti is 2.5 to 7.0.

6. The steam turbine according to claim 1, wherein the first rotor member includes 0.005 to 0.1 wt % of C, 8 to 15 wt % of Cr, 5 to 20 wt % of W, 1 to 7 wt % of Mo, 0.5 to 1.0 wt % of Al, 1.0 to 2.5 wt % of Ti, and the remainder of Ni and inevitable impurities.

7. The steam turbine according to claim 1, wherein the first rotor member includes one or two elements of 0.15 wt % or less of C, 1 wt % or less of Si, 1 wt % or less of Mn, 5 to 15 wt % of Cr, 17 to 25 wt % of including one or two or more of Mo, W, and Re: Mo+(W+Re)/2, 0.2 to 2 wt % of Al, 0.5 to 4.5 wt % of Ti, 10 wt % or less of Fe, 0.02 wt % or less of B, 0.2 wt % or less of Zr; and the remainder of Ni and inevitable impurities, wherein wt % of Al+Ti is 2.5 to 7.0, and wherein the second rotor member includes 0.08 to 0.25 wt % of C, 0.10 wt % or less of Si, 0.10 wt % or less of Mn, 0.05 to 1.0 wt % of Ni, 10 to 12.5 wt % of Cr, 0.6 to 1.9 wt % of Mo, 1.0 to 1.95 wt % of W, 0.10 to 0.35 wt % of V, 0.02 to 0.10 wt % of Nb, 0.01 to 0.08 wt % of N, 0.001 to 0.01 wt % of B, 2.0 to 8.0 wt % of Co, and the remainder of Fe and inevitable impurities.

8. The steam turbine according to claim 1, wherein the first rotor member includes 0.005 to 0.1 wt % of C, 8 to 15 wt % of Cr, 5 to 20 wt % of W, 1 to 7 wt % of Mo, 0.5 to 1.0 wt % of Al, 1.0 to 2.5 wt % of Ti, and the remainder of Ni and inevitable impurities, and wherein the second rotor member includes 0.08 to 0.25 wt % of C, 0.10 wt % or less of Si, 0.10 wt % or less of Mn, 0.05 to 1.0 wt % of Ni, 10 to 12.5 wt % of Cr, 0.6 to 1.9 wt % of Mo, 1.0 to 1.95 wt % of W, 0.10 to 0.35 wt % of V, 0.02 to 0.10 wt % of Nb, 0.01 to 0.08 wt % of N, 0.001 to 0.01 wt % of B, 2.0 to 8.0 wt % of Co, and a remainder of Fe and inevitable impurities.

9. A high and intermediate pressure integral-type steam turbine that is formed to have rotor members which are formed of different materials from each other and which are joined to each other in an axial direction, the high and intermediate pressure integral-type steam turbine comprising:

a first rotor member;

two second rotor members;

a casing which includes a guide portion through which a working fluid is guided and two discharge portions through which the working fluid is discharged;

a plurality of sealing portions;

a plurality of bearings, wherein the first rotor member is formed of an Ni-based alloy, wherein the first rotor member includes a hollow inside in the axial direction, wherein the guide portion is open radially inward towards the first rotor member, wherein the first rotor member includes a rotor vane, across which high pressure steam passes, on a side thereof having a first end in the axial direction and includes a rotor vane, across which intermediate pressure steam passes, on a side thereof having a second end in the axial direction, wherein the first rotor member cooperates with one of the sealing portions to partition between the high pressure steam and the intermediate pressure steam at a portion close to a center of the first rotor member in the axial direction, wherein the second rotor members are formed of a material which is more easily molded than the Ni-based alloy, wherein insides of the second rotor members are solid, wherein the second rotor members are joined to the first rotor member at the first end and the second end, respectively, in the axial direction, wherein the discharge portions are open radially inward towards the second rotary members, respectively, wherein one of the second rotor members includes a rotor vane, across which the high pressure steam passes, on a joint side with the first rotor member, wherein one of the sealing portions and one of the bearings are disposed away from the joint side of the one of the second rotor members, wherein the other of the second rotor members includes a rotor vane, across which the intermediate pressure steam passes, on a joint side with the first rotor member, wherein an other of the sealing portions and an other of the bearings are disposed away from the joint side of the other of the second rotor members, wherein the first end of the first rotor member and a joint portion of the one of the second rotor members with the first rotor member are disposed in a pressure range, wherein the second end of the first rotor member and a joint portion of the other of the second rotor members with the first rotor member are disposed in another pressure range, wherein a number of vane rows on the first end side of the first rotor member is greater than a number of vane rows of the one of the second rotor members, wherein a number of vane rows on the second end side of the first rotor member is greater than a number of vane rows of the other of the second rotor members, and wherein an average linear expansion coefficient of the first rotor member in a temperature range of room temperature to 700° C. which becomes an operation region of the steam turbine is in a range of $12.4\times10^{-6}$/°C. to $14.5\times10^{-6}$/°C. and an average linear expansion coefficient of the second rotor member is in a range of $11.2\times10^{-6}$/°C. to $12.4\times10^{-6}$/°C.

10. The high and intermediate pressure integral-type steam turbine according to claim 9, wherein a thickness of the first rotor member on the second end side is greater than the thickness of the first rotor member on the first end side.

11. The high and intermediate pressure integral-type steam turbine according to claim 9, wherein a thickness of the first rotor member becomes greater toward the first end and the second end.

12. The high and intermediate pressure integral-type steam turbine according to claim 9, wherein the first rotor member includes a first portion of the first end side in the axial direction and a second portion of the second end side in the axial direction, and wherein the hollow inside of the first rotor member is provided only on the second portion of the second end side in the axial direction.

13. The high and intermediate pressure integral-type steam turbine according to claim 9, wherein the first rotor member includes one or two elements of 0.15 wt % or less of C, 1 wt % or less of Si, 1 wt % or less of Mn, 5 to 15 wt % of Cr, 17 to 25 wt % of including one or two or more of Mo, W, and Re: Mo+(W+Re)/2, 0.2 to 2 wt % of Al, 0.5 to 4.5 wt % of Ti, 10 wt % or less of Fe, 0.02 wt % or less of B and 0.2 wt % or less of Zr; and the remainder of Ni and inevitable impurities, and wherein wt % of Al+Ti is 2.5 to 7.0.

14. The high and intermediate pressure integral-type steam turbine according to claim 9, wherein the first rotor member includes 0.005 to 0.1 wt % of C, 8 to 15 wt % of Cr, 5 to 20 wt % of W, 1 to 7 wt % of Mo, 0.5 to 1.0 wt % of Al, 1.0 to 2.5 wt % of Ti, and the remainder of Ni and inevitable impurities.

15. The high and intermediate pressure integral-type steam turbine according to claim 9, wherein the first rotor member includes one or two elements of 0.15 wt % or less of C, 1 wt % or less of Si, 1 wt % or less of Mn, 5 to 15 wt % of Cr, 17 to 25 wt % of including one or two or more of Mo, W, and Re: Mo+(W+Re)/2, 0.2 to 2 wt % of Al, 0.5 to 4.5 wt % of Ti, 10 wt % or less of Fe, 0.02 wt % or less of B, 0.2 wt % or less of Zr; and the remainder of Ni and inevitable impurities, wherein wt % of Al+Ti is 2.5 to 7.0, and wherein the second rotor members include 0.08 to 0.25 wt % of C, 0.10 wt % or less of Si, 0.10 wt % or less of Mn, 0.05 to 1.0 wt % of Ni, 10 to 12.5 wt % of Cr, 0.6 to 1.9 wt % of Mo, 1.0 to 1.95 wt % of W, 0.10 to 0.35 wt % of V, 0.02 to 0.10 wt % of Nb, 0.01 to 0.08 wt % of N, 0.001 to 0.01 wt % of B, 2.0 to 8.0 wt % of Co, and the remainder of Fe and inevitable impurities.

16. The high and intermediate pressure integral-type steam turbine according to claim 9, wherein the first rotor member includes 0.005 to 0.1 wt % of C, 8 to 15 wt % of Cr, 5 to 20 wt % of W, 1 to 7 wt % of Mo, 0.5 to 1.0 wt % of Al, 1.0 to 2.5 wt % of Ti, and the remainder of Ni and inevitable impurities, and wherein the second rotor members include 0.08 to 0.25 wt % of C, 0.10 wt % or less of Si, 0.10 wt % or less of Mn, 0.05 to 1.0 wt % of Ni, 10 to 12.5 wt % of Cr, 0.6 to 1.9 wt % of Mo, 1.0 to 1.95 wt % of W, 0.10 to 0.35 wt % of V, 0.02 to 0.10 wt % of Nb, 0.01 to 0.08 wt % of N, 0.001 to 0.01 wt % of B, 2.0 to 8.0 wt % of Co, and a remainder of Fe and inevitable impurities.

* * * * *